US005862971A

United States Patent [19]

Ebner

[11] Patent Number: 5,862,971

[45] Date of Patent: Jan. 26, 1999

[54] STAPLING APPARATUS

[75] Inventor: Arno Ebner, Ammerbuch, Germany

[73] Assignee: Eastman Kodak Company, Rochester, N.Y.

[21] Appl. No.: 795,908

[22] Filed: Feb. 5, 1997

[30] Foreign Application Priority Data

Feb. 27, 1996 [DE] Germany ..... 196 07 296.4

[51] Int. Cl.[6] ..... B27F 7/19

[52] U.S. Cl. ..... 227/155; 227/153

[58] Field of Search ..... 227/152, 153, 227/154, 155

[56] References Cited

U.S. PATENT DOCUMENTS

| | | | |
|---|---|---|---|
| 4,493,847 | 1/1985 | Hagemann | 227/155 |
| 4,546,910 | 10/1985 | Logtens | 227/155 |
| 5,133,493 | 7/1992 | Russel et al. | 227/155 |
| 5,141,143 | 8/1992 | Ebner et al. . | |
| 5,385,287 | 1/1995 | Scheuten . | |
| 5,588,326 | 12/1996 | Stroter et al. | 227/155 |
| 5,678,745 | 10/1997 | Yoshie | 227/155 |

*Primary Examiner*—Scott A. Smith

*Attorney, Agent, or Firm*—Lawrence P. Kessler

[57] ABSTRACT

A stapling apparatus (1) has a stationary stapling head (9) and a counterbearing(13), fastened to a slider(4) and equipped with a clinching apparatus (14), that is fastened to slider (4). The slider (4) has parallel clamping surfaces (4*d*, 4*e*), associated with which are a clamping element (19), mounted in stationary pivotable fashion and having clamping jaws (19*c*, 19*d*) and edges (19*e*, 19*f*), that can be positioned by a torsion spring (21), pivotably about a bearing (19*a*), against the clamping surfaces (4*d*, 4*e*) of the slider (4). The clamping element (19) is spring-loaded opposite to a movement direction "B" of the slider (4). The pivot bearing (19*a*) of the clamping element (19) is arranged at a distance (r) from the slider (4) that is related by a ratio $l/r<2\ \mu$, which effects self-locking, to the length (l) of the clamping jaws (19*c*, 19*d*). When a force which attempts to move the slider (4) opposite to the direction of arrow "B" acts, as a result of the stapling operation, on the counterbearing (13), jamming of the clamping element (19) occurs by self-locking, thus causing immediate blocking of the slider (4). After completion of the stapling operation, an actuator (5) of the clinching apparatus (14) releases the blocling of the slider (4) by positive pivoting of the clamping element (19).

7 Claims, 7 Drawing Sheets

STAPLING APPARATUS

BACKGROUND OF THE INVENTION

The invention relates to a stapling apparatus for stapling sheets arranged in stacks, with a stapling head which drives the staples in from the one side, and with a counterbearing, associated with the other side, on which a clinching apparatus which clinches the ends of the staples is arranged; the stapling apparatus having a slider that can be moved by a drive apparatus having a radial cam, and that controls raising or adjustment of the counterbearing.

In a stapling apparatus of this kind disclosed by U.S. patent application Ser. No. 5,141,143, before the stapling operation the counterbearing is directed from above toward the sheet stack being stapled, but initially is not in contact with it. The operation of driving in the staple, occurring from the underside, occurs with interposition of a compression spring. During the driving operation the sheet stack is raised and laid against the counterbearing, the compression spring effecting compensation for the thickness of the sheet stack. Because the sheet stack being stapled is raised prior to the stapling operation, its position can shift, so that precisely aligned guidance of the staple during the stapling operation is not guaranteed. In addition, the known stapling apparatus requires a comparatively high drive torque and thus high drive motor output, since the compression spring, designed to transfer the maximum driving-in force, must be compressed at each thickness compensation operation.

SUMMARY OF THE INVENTION

It is the object of the invention to configure a stapling apparatus of this kind in such a way that the sheet stack being stapled is not moved during stapling, and the load on the drive apparatus is reduced.

This is achieved, according to the invention, in that:

- the slider having the counterbearing and the clinching apparatus rests in spring-loaded contact against a first radial cam of the drive apparatus;
- the slider is guided displaceably parallel to the stapling direction and has two clamping surfaces extending parallel thereto and arranged at a distance from one another;
- associated with the clamping surfaces of the slider is a stationary and pivotably mounted clamping element that has two clamping jaws, arranged in parallel fashion and each equipped with an edge, of which a first clamping jaw or its edge is associated with the one clamping surface, and a second clamping jaw or its edge is associated with the other clamping surface of the slider;
- the distance between the clamping jaws of the clamping element is slightly greater than the distance of the two opposing clamping surfaces;
- the pivot mount of the clamping element is arranged at a distance from the slider that is in a relationship to the length of the clamping jaws which effects self locking;
- the clamping element can be laid in spring-loaded fashion against the clamping surfaces of the slider, opposite to the movement direction of the slider which effects compensation for the stack thickness; and
- the stapling head is arranged in stationary fashion beneath the sheet stack being stapled, and is driven positively by a third radial cam of the drive apparatus.

In an advantageous modification of the invention, the clamping element is coupled to the actuator of the clinching apparatus for the staple ends in such a way that after completion of the stapling operation, and once no further reaction force is acting on the counterbearing, the clamping element is pivoted back into a neutral position in which its clamping jaws allow the slider to move back freely. At the end of the backward movement, the clamping element, controlled by the actuator, comes back into contact against the slider.

The advantageous result of the particular configuration, arrangement, and operation of the clamping element of the stapling apparatus according to the invention is that until the counterbearing contacts the sheet stack being stapled, the slider can move freely without being influenced by the clamping element.

As soon as a reaction force, caused by driving in a staple and acting on the counterbearing, attempts to move the slider in the opposite direction, the clamping element, mounted in stationary fashion, jams immediately against the clamping surfaces of the slider by pivoting in spring-loaded fashion. The clamping element, mounted in stationary fashion, absorbs the reaction force which occurs at the counterbearing during stapling. The advantageous result of this feature is that the counterbearing is now fixed, by the blocked slider, in a stationary position which allows no movement of the sheet stack being stapled, so that the staple can pass in an accurately guided manner through the sheet stack into the active region of the clinching apparatus for the staple ends.

Because the stapling apparatus is positioned in stationary fashion during stapling, and because no compensation spring needs to be actuated in order to compensate for stack thickness, smooth operation at lower drive output is advantageously achieved.

DESCRIPTION OF THE DRAWINGS

Further features and advantages are evident from the description of an embodiment of the invention depicted in the drawings, and from the subclaims. In the schematic drawing

DETAILED DESCRIPTION OF THE INVENTION

Figure 1:
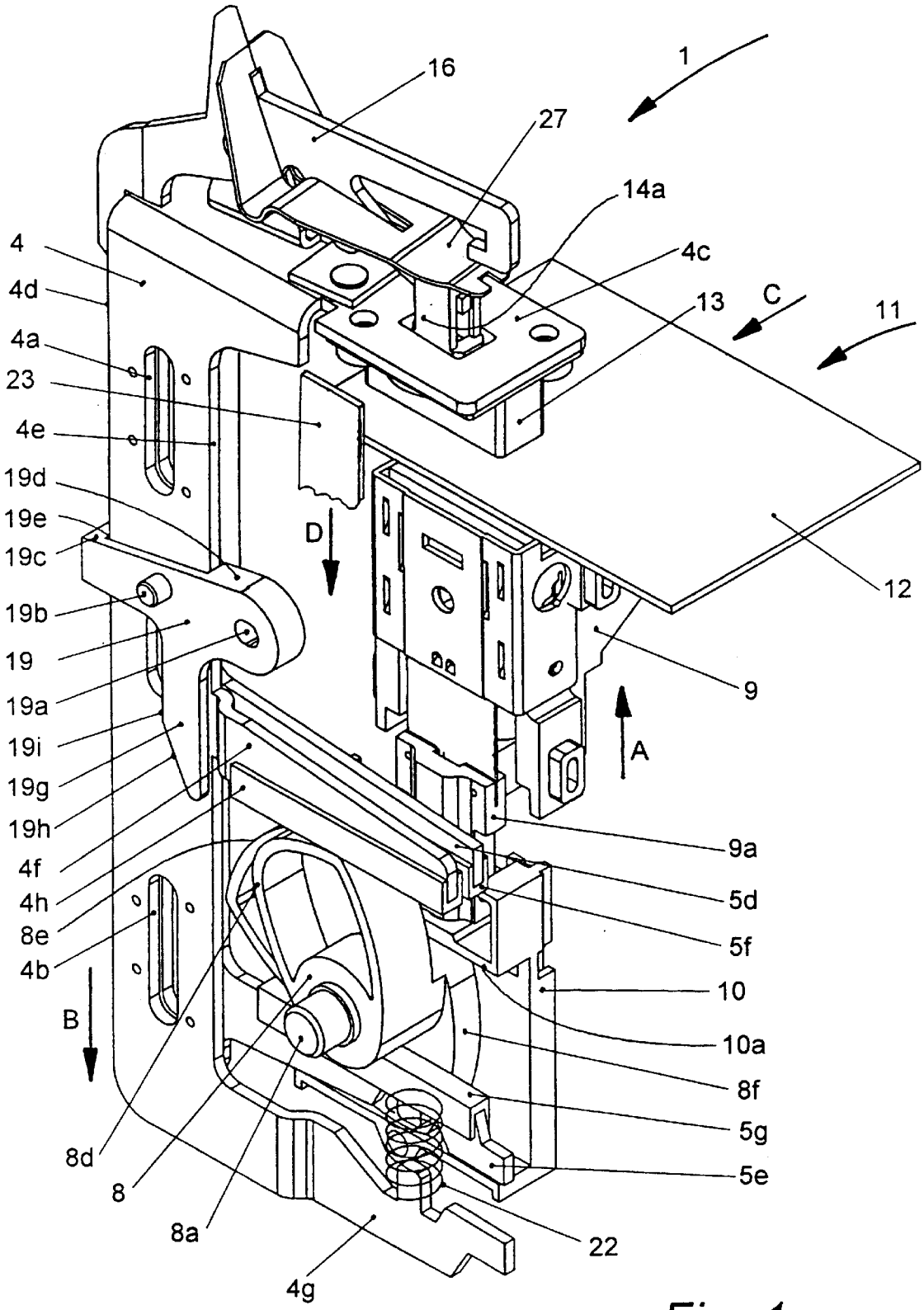
FIG. 1 shows the apparatus in an oblique view.

The stapling apparatus according to the invention is arranged on a downline processing apparatus (not depicted) of known type, in which individually fed-in sheets, in particular copied sheets delivered from a copier, are collected into stacks in a collecting station 11, and stapled together in batches by means of staples.

Stapling apparatus 1 is mounted as a complete module between or on two housing parts 2 and 3, which can be bolted rigidly to one another and are fastened in stationary fashion to the downline processing unit (not depicted). The components, to be describe individually later, are mounted displaceably, rotatably, and/or pivotably on housing part 2, stationary mounting studs 6, 7, which not only guide components but also join the two housing parts 2 and 3, being provided.

Stapling apparatus 1 has a slider 4 and an actuator 5 which are guided slidingly and independently of one another, by means of guide slots 4*a*, 4*b* and 5*a*, 5*b*, respectively, on mounting studs 6 and 7 of housing part 2.

Slider 4 and actuator 5 are driven by a radial cam unit 8, made of plastic, onto which are formed pivot pins 8*a* and 8*b* that are rotatably mounted, by means of ball bearings (not depicted),at bearing points 2*a* and 3*a* of housing parts 2 and 3, respectively. Radial cam unit 8 also actuates a stapling head 9 of a known and commercially standard type, which is configured to shape and drive in sections of wire, assembled into belts, that are fed into stapling head 9 from a cassette (not depicted). A drive motor (not depicted) for stapling apparatus 1 engages into an end-surface groove 8*c* of radial cam unit 8. Stapling head 9, with the cassette that is also commercially standard, is fastened in stationary fashion to housing part 2 in a manner not depicted, the cassette with the wire sections being arranged replaceably.

Stapling head 9, arranged in stationary fashion beneath a sheet stack 12 to be stapled, has a displaceable driver 9*a* which is actuated by a link member 10 that is displaceably guided on housing part 3 and is in positive engagement with radial cam unit 8.

Associated with stapling head 9 is a counterbearing 13, arranged above sheet stack 12 to be stapled, that is fastened to an upper first arm 4*c* of slider 4 which projects beyond the region of sheet stack 12 that is to be stapled.

Arranged on counterbearing 13 is a clinching apparatus 14 (not depicted) for the staple ends, which is configured for example in accordance with U.S. application Ser. No. 5,385,287. This clinching apparatus has a displaceable plunger 14*a* which acts by rotatably mounted rollers on pivotable bending elements (not depicted), by which the staple ends can be clinched. Plunger 14 is actuated, with interposition of a spring 15 (see Figures and 4), by a lever 16 that is arranged pivotably about a bearing 17 arranged on upper arm 4*c* of slider 4. A roller 18 which projects into the movement path of upper end surface 5*i* of actuator 5 is arranged on lever 16.

Associated with slider 4 is a clamping element 19 that is mounted, by means of an elongated hole 19*a*, so as to pivot on a stud 20 fastened to housing part 2, and to move perpendicular to the movement direction of slider 4. A torsion spring 21, which acts on clamping element 19 so as to pivot it clockwise, engages on a projection 19*b* of clamping element 19. Clamping element 19 has two clamping jaws 19*c* and 19*d*, which have mutually facing parallel surfaces that are delimited by edges 19*e* and 19*f* respectively. Slider has clamping surfaces 4*d* and 4*e*, arranged in parallel fashion, with which clamping jaws 19*c* and 19*d* of clamping element 19 are associated in such a way that their edges 19*e* and 19*f* can be laid, in spring-loaded fashion, against clamping surfaces 4*d* and 4*e*, respectively, of slider 4.

As a result of the action on clamping element 19 occurring in the clockwise direction, the spring force of torsion spring 21 acts on slider 4 in such a way that the latter can move freely in a first movement direction, occurring in the direction of arrow "B", that acts (in a manner yet to be described) to set counterbearing 13 (sheet stack thickness adjustment) on top of sheet stack 12. The movement of slider 4 in the direction of arrow "B" is directed opposite to the direction of action (clockwise) of torsion spring 21. As a result, clamping element 19 is influenced by frictional engagement between clamping surfaces 4*d*, 4*e* and edges 19*e*, 19*f* opposite to the direction of action of torsion spring 21, as a result of which the spring action is relieved and clamping element 19 is acted upon opposite to its (clockwise) clamping direction which engenders blocking (to be described later) of slider 4.

But as soon as a force directed against the direction of arrow "B", caused by the stapling operation, acts on slider 4, the latter is automatically and immediately blocked by self-locking by means of clamping element 19, in a manner yet to be described, so that it can no longer move.

To achieve this effect, elongated hole 19*a* is arranged at a distance r from the center axis of slider 4 that is related by a ratio of $l/r<2\mu$ to the length l of clamping jaws 19*c*, 19*d*, which effects self-locking.

The embodiment is based on the following values:

coefficient of friction, steel on steel, dry: $\mu$=0.15 (selected)

distance r from center axis of slider 4:r=30 mm (given)

length l of clamping jaws 19*c*, 19*d*:l=8 mm (selected)

Figure 6:
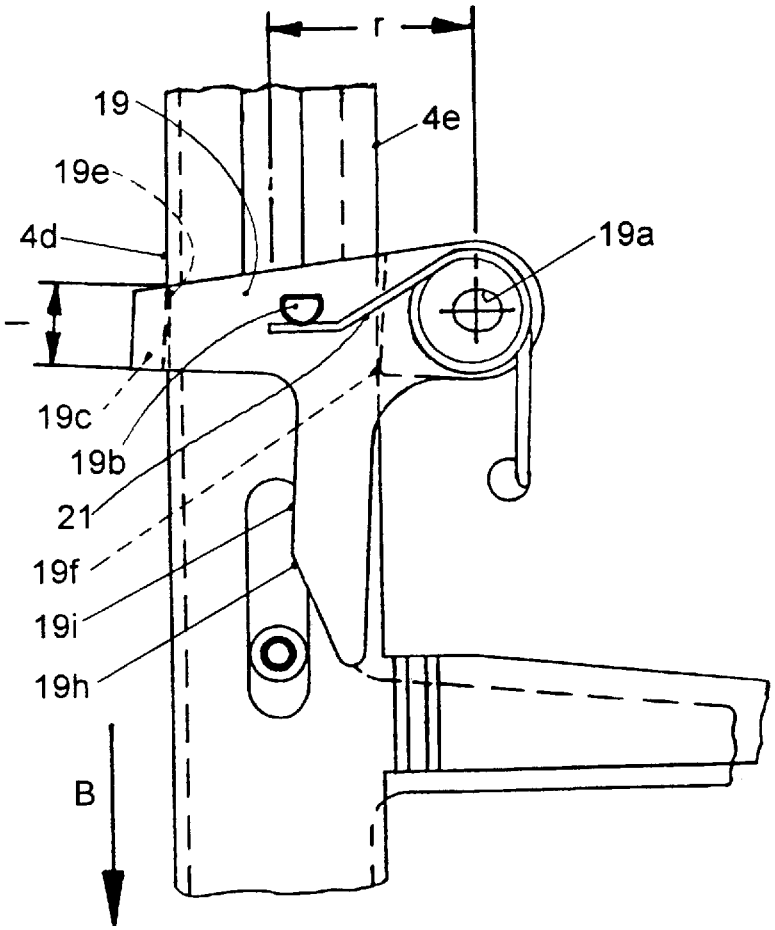
FIG. 6 shows a partial view of the apparatus according to FIG. 4.
Figure 7:
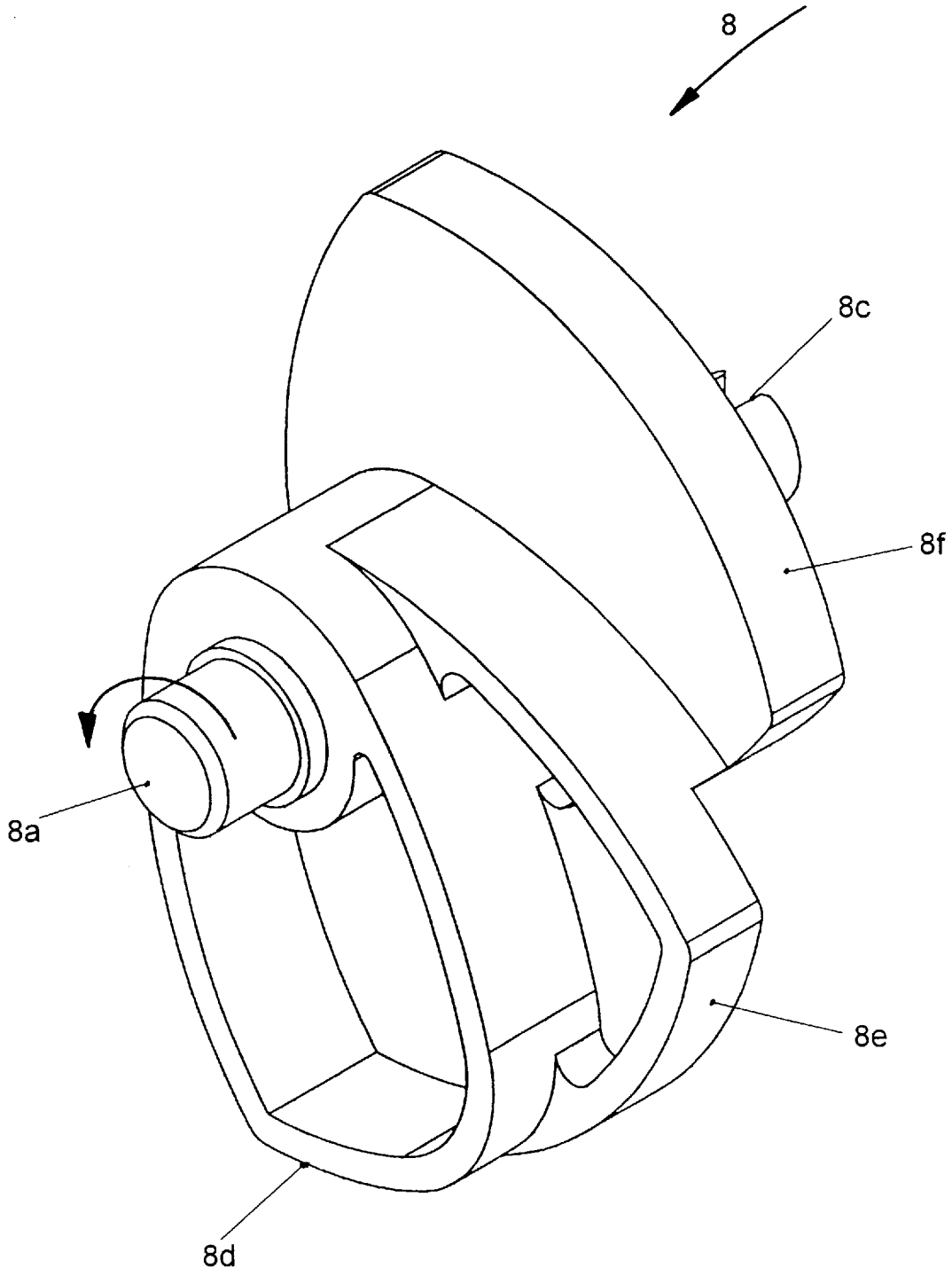
FIG. 7 shows a detail of the apparatus according to FIGS. 1 to 4.

The distance between clamping jaws 19*c* and 19*d* is slightly greater (0.4 to 0.6 mm) than the distance between the two opposing clamping surfaces 4*d* and 4*e*. Because of the spring loading by torsion spring 21, the result is a slight tilt, visible in particular in FIGS. 4 and 6, of clamping jaws 19*c* and 19*d* with respect to clamping surfaces 4*d* and 4*e*, so that only their edges 19*e* and 19*f* are in contact with clamping surfaces 4*d* and 4*e*, respectively.

Elongated hole 19*a*, on which clamping element 19 is mounted, ensures that clamping element 19 can be moved far enough laterally to ensure that both edges 19*e* and 19*f* of clamping element 19 are in simultaneous and uniform contact with clamping surfaces 4*d* and 4*e* of slider 4.

Clamping element 19 is further more equipped with an arm 19*g* that can be positioned in spring-loaded fashion, by means of a surface 19*i* arranged parallel to movement direction "B" of slider 4, against a projection 5*c* of actuator 5. Arm 19*g* has, toward its free end, a ramp 19*h* continuous with surface 19*i* and extending away from projection 5*c*.

Arm 19*g* can be positioned, with its surface 19*i*, against projection 5*c* of actuator 5 in such a way that clamping jaws 19*c* and 19*d* assume a position aligned parallel to clamping surfaces 4*d* and 4*e*, respectively, of slider 4 (see FIG. 5), in which they allow unimpeded backward movement of slider 4.

Figure 2:
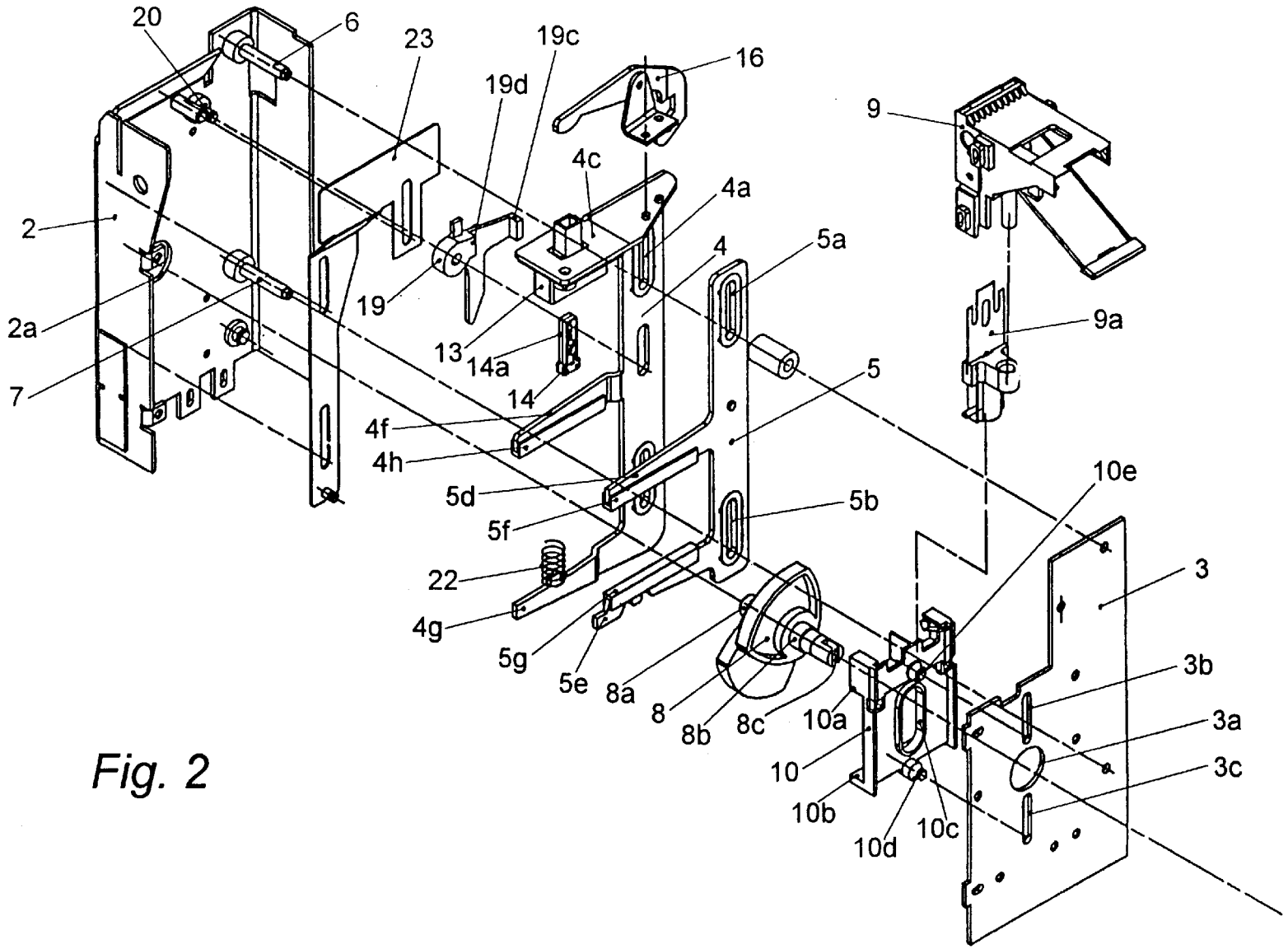
FIG. 2 shows the apparatus in an exploded depiction.

As is evident in particular from FIG. 2, slider 4 and actuator 5 have upper and lower arms 4*f*, 4*g* and 5*d*, 5*e*, respectively.

Upper arm 4*f* of slider 4, which is made of metal is equipped with a runner 4*h* made of plastic, which under the action of a compression spring 22 rests against a first radial cam 8*d* of radial cam unit 8, the preloaded compression spring 22 being arranged between the top side of the lower, bent arm 4*g* of slider 4 and the underside of lower arm 5*e* of actuator 5.

Arms 5*d* and 5*e* of actuator 5 are also equipped with runners 5*f* and 5*g*, which engage on a second radial cam 8*e*, configured with the same thickness, of radial cam unit 8.

The third radial cam 8*f* of radial cam unit 8, also configured with the same thickness, is arranged between two jaws 10*a* and 10*b* of a link member 10 which is displaceable in a stapling direction "A" and is made of plastic. Link member 10 is displaceably guided, by means of pin/slot guides 3*b*, 3*c* and 10*c*, 10*d*, 10*e*, on second housing part 3 and in the region of pivot pin 8*b* of radial cam unit 8, respectively.

Driver 9*a* of stapling head 9 is actuatable with top side 10*f* of link member 10; a displaceably guided stud 24 with a transverse pin 25, projecting on either side of stud 24 and positively guided in a groove (not depicted) of driver 9*a*, is arranged at the lower end of driver 9*a*. The groove, open toward the bottom, serves at its top end as a stop for transverse pin 25. Stud 24 and driver 9*a* are non-positively joined to one another via a preloaded compression spring (not depicted).

Stapling apparatus 1 also has a front stop 23, respectively indicated and depicted in FIGS. 1 and 2, against which the sheets being stapled can be aligned at their ends. Stop 23 is guided displaceably in the direction of arrow "D", and is actuated by an electromagnetic drive (not depicted).

Figure 3:
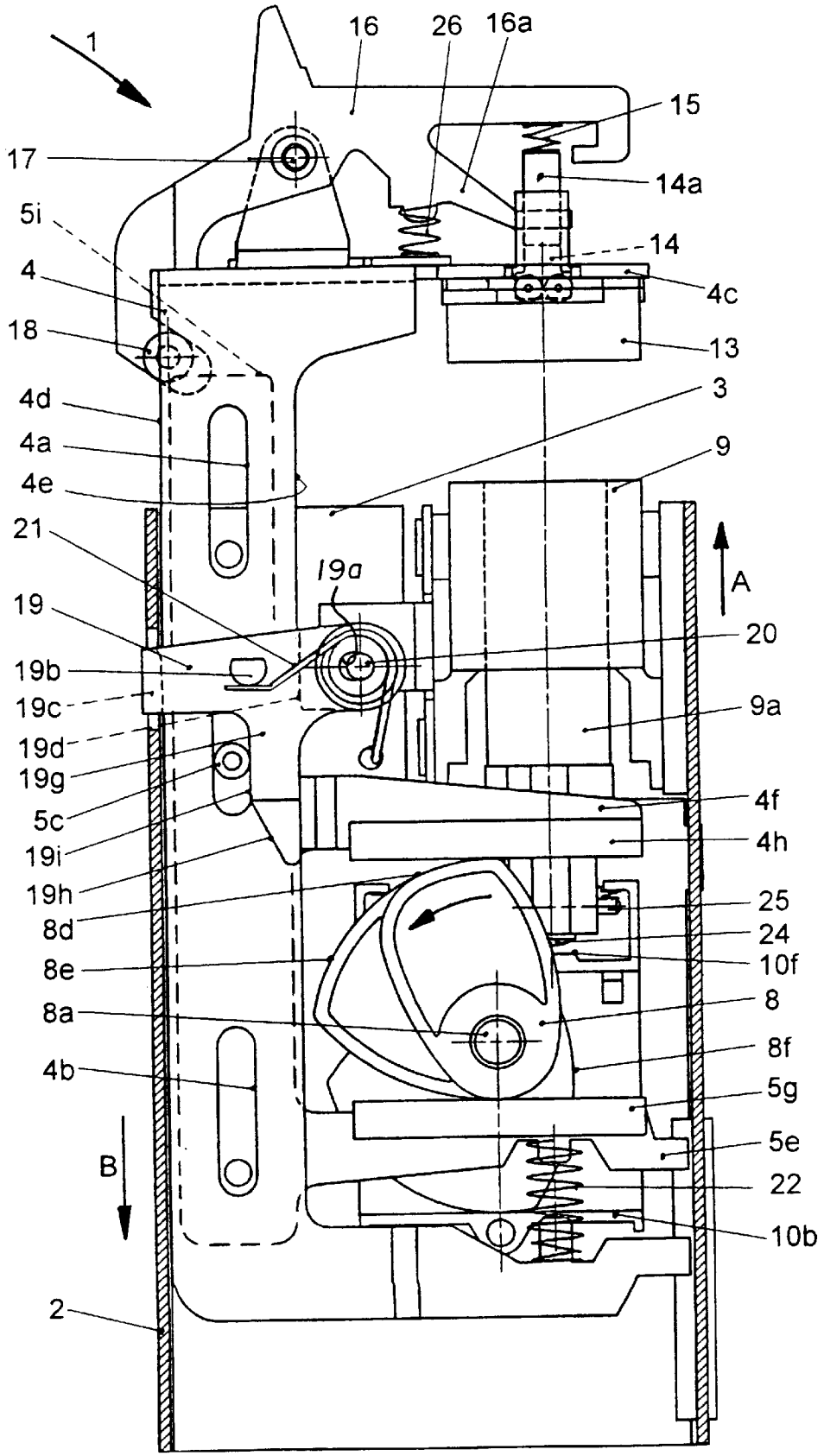
FIG. 3 shows the apparatus according to FIG. 1 in a front view, in the starting position.
Figure 4:
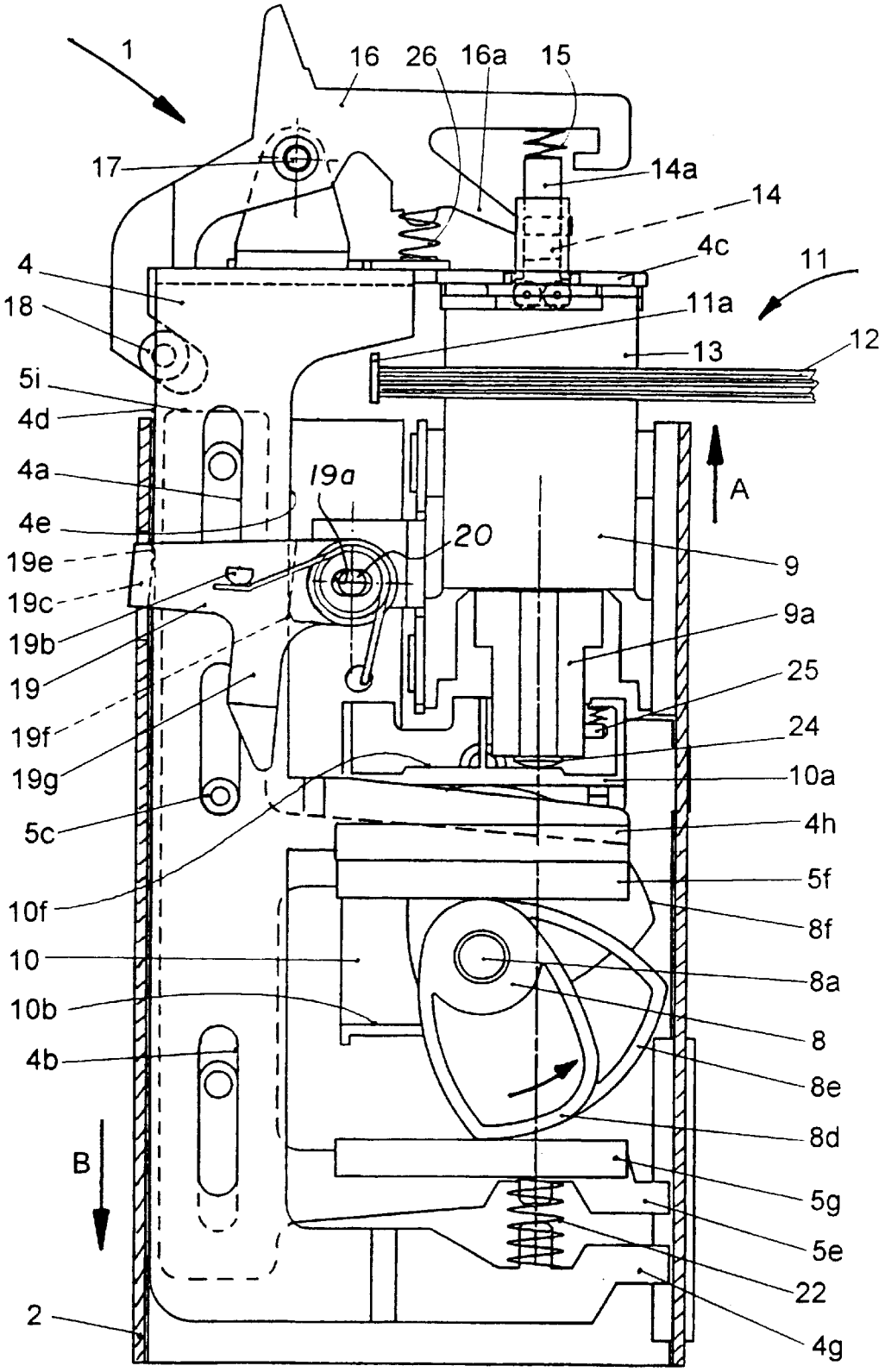
FIG. 4 shows the apparatus according to FIG. 1 in a front view, in the stapling position.
Figure 5:
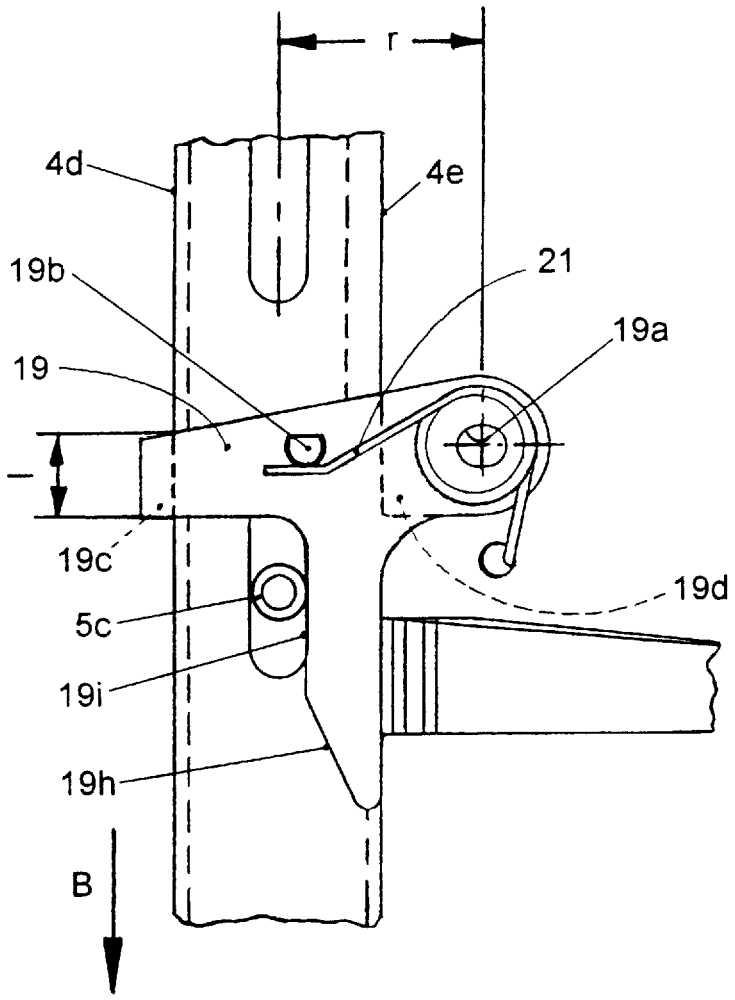
FIG. 5 shows a partial view of the apparatus according to FIG. 3.

The apparatus operates as follows:

In accordance with FIGS. 1, 3, and 5, the apparatus assumes a position in which counterbearing 13 is raised far enough away from collection station 11 that the sheets arriving in the direction of arrow "C" can arrive unimpeded at front stop 23, at which they are aligned in a known manner (not depicted). FIG. 4 also indicates a lateral, stationary stop 11*a* of collecting station 11.

As soon as the number of sheets to be stapled has been collected, radial cam unit 8 is driven so as to rotate counter clockwise (with reference to FIGS., 3, and 4). Second radial cam 8*e* thus moves actuator 5 downward in the direction of arrow "B", and by preloaded compression spring 22 drags slider 4 along in the same direction. Clamping element 19 thereby initially occupies a neutral position in which, with surface 19*i* resting against projection 5*c* of actuator 5, it exerts no influence on slider 4. As actuator 5 moves further in the direction of arrow "B", projection 5*c* arrives at ramp 19*h* of clamping element 19. Clamping element 19 then pivots in response to torsion spring 21, automatically rotating clockwise into the tilted position visible in FIGS. 4 and 6, in which edges 19*e* and 19*f* of clamping jaws 19*c* and 19*d* lie in spring-loaded contact against clamping surfaces 4*d* and 4*e*, respectively, of slider 4. As already described above, both edges 19*e* and 19*f* lie simultaneously and uniformly in contact against clamping surfaces 4*d* and 4*e*, but do not prevent slider 4 from moving in the direction of arrow "B".

As soon as counterbearing 13 rests on top of sheet stack 12 being stapled, continued rotation of radial cam unit 8 compresses compression spring 22, thus compensating for the different path lengths of slider 4 and actuator 5 resulting from the variable thickness of different sheet stacks.

During the control movements of actuator 5 and slider 4 just described, a concentric circular arc section of third radial cam 9*f*, associated with driver 9*a* of stapling head 9 and engaging on lower jaw 10*b* of link member 10, is effective, so that driver 9*a* does not move.

When slider 4 reaches its bottom end position, a concentric circular arc section of second radial cam 8*e* of radial cam unit 8 becomes effective, so that actuator 5, and slider 4 taken along with it, do not move.

As soon as slider 4 and actuator 5 stop moving, upon further rotation of radial cam unit 8, still counter-clockwise, a rising curve section of third radial cam 8*f* becomes effective. This pushes link member 10 upward, so that by means of stud 24 in contact with it, and the compression spring (not depicted), driver 8*a* is non-positively moved in the direction of arrow "A".

This movement of driver 8*a* in the direction of arrow "A" causes a wire section of the belt of stapling wire to be bent into a staple, detached from the belt of stapling wire, and driven from below into sheet stack 12. As soon as a force caused by the stapling operation and directed in the direction of arrow "A", which attempts to move slider 4 opposite to the direction of arrow "B", acts on counterbearing 13, clamping element 19 jams with its edges 19*e* and 19*f* against clamping surfaces 4*d* and 4*e*, respectively, of slider 4, and prevents it from moving opposite to movement direction "B". The automatic jamming is engendered by the friction, which causes self-locking, between edges 19*e* and 19*f* and clamping surfaces 4*d* and 4*e*, respectively, of slider 4, which becomes effective, when slider 4 reverses direction, because of the previously described configuration and arrangement of clamping element 19 and slider 4. Frictionally engaged contact between edges 19*e* and 19*f* of clamping element 19, and clamping surfaces 4*d* and 4*e*, respectively, causes slider 4 to be blocked which takes effect immediately.

Since slider 4 is blocked in the manner described as the actual stapling operation begins, counterbearing 13 arranged on it is fixed in a stationary position during that blocking. Because clamping element 19 is mounted directly on housing part 2 and is thus stationary on the Luit, the force acting on counterbearing 13 in reaction to the staple insertion force (up to approx. 200N), is absorbed by the unit. Since counterbearing 13 is fixed in stationary fashion and stapling head 9 is mounted in stationary fashion, sheet stack 12 being stapled can be neither raised nor otherwise moved during stapling, so that the preformed staples, when subsequently driven into sheet stack 12, can reliably pass through sheet stack 12 into the active region of clinching apparatus 14 arranged in counterbearing 13. This feature leads to consistent stapling quality. Moreover, the fact that sheet stack 12 does not move during the stapling operation results in smooth operating which saves drive energy, since the cassette for the wire sections (not depicted) arranged on stapling head 9, and collecting station 11, also do not need to be moved.

Since the sheet thickness compensation by means of slider 4 described above renders unnecessary a compensation spring for sheet thickness compensation that would otherwise be provided, and would of course need to be made at least as strong as the maximum required stapling force, only a comparatively low drive torque for the radial cam unit, and thus a comparatively lower drive motor output, are required. Decreased bearing wear is also achieved, since the apparatus needs to absorb only the insertion force necessary in each case, and need not always be stressed with the maximum required insertion force.

The insertion force required for driving the staples into sheet stack 12 is greater than the preload of the compression spring arranged between stud 24 and driver 9*a*. As the staple is being driven in, the compression spring is therefore compressed to the point that transverse pin 25, at the upper end of its guide groove, strikes driver 9*a* and positively entrains it. As soon as the staple ends have been punched through sheet stack 12, the force required decreases to the point that transverse pin 25, in response to the now sufficient preload of the compression spring, away from contact with the guide groove, and further penetration of the staple through sheet stack 12 takes place non-positively until the staple crosspiece is in contact with the underside of sheet stack 12. The aforesaid interposed compression spring then makes possible a movement compensation at the end of the staple driving process, during an overrun (which occurs to compensate for tolerances) until link member 10 reaches its upper end position.

Once the staple has been driven into sheet stack 12, the staple ends projecting upward out of sheet stack 12 are clinched and pressed so as to lie flat against the top of sheet stack 12. During this operation the concentric circular arc section of third radial cam 8*f* of radial cam unit 8, which is now in contact with upper jaw 10*a* of link member 10, is effective, so that link member 10 and thus driver 9*a* do not move.

As radial cam unit 8 continues to rotate counter-clockwise, and with link member 10 at a standstill, a rising curve section of second radial cam 8*e*, which in contact with runner 5*f* of upper arm 5*d* moves actuator 5 upward opposite to the direction of arrow "B", becomes effective. By means of roller 18 engaging on upper end surface 5*i* of actuator 5, lever 16 is pivoted clockwise so that plunger 14*a* is moved downward by spring 15 opposite to the direction of arrow "A" and thereby actuates clinching apparatus 14, which in a known manner (not depicted) bends the staple ends over and lays them against the top of the stack. When the staple ends are lying against sheet stack 12, spring 15 is compressed and thus permits a movement compensation. A travel gap corresponding to the sheet stack thickness exists between actuator 5 and roller 18.

As actuator 5 continues to move it slides past roller 18, spring 15 making possible a movement compensation between lever 16 and plunger 14*a*. Actuator 5, which has continued to move opposite to the direction of arrow "B", releases, by means of its projection 5*c* which strikes ramp 19*h*, the blocking of slider 4 by pivoting clamping element 19 counter-clockwise and, as shown in FIG. 5, bringing its surface 19*i* into contact with projection 5*c*. The apparatus is then brought, by further counter-clockwise rotation of radial cam unit 8, into its starting position according to FIG. 3, slider 4 also being brought by first radial cam 8*d* into its starting position according to FIG. 3.

Concurrently with the return of slider 4 and actuator 5 described above, driver 9*a* of stapling head 9 is also brought, by means of link member 10 and third radial cam 8*f* of radial cam unit 8, into its starting position according to FIG. 3.

When the starting position according to FIG. 3 is reached, the drive system of stapling apparatus 1 is shut down.

Arranged on lever 16 is an arm 16*a* that engages, by means of a spring 26, on plunger 14*a* of clinching apparatus 14 in such a way that when operationally related blocking occurs during the return of plunger 14*a*, positive entrainment of plunger 14*a* into the starting position can occur.

Once the stapling operation is complete and counterbearing 13 has been raised, front stop 23 as shown in FIGS. 1 and 2 is moved downward in the direction of arrow "D" so that the stapled sheet stack 12 can be transported out of collection station 11 in the direction of arrow "C" (see FIG. 1).

As a variant of the embodiment described, there can also be arranged on actuator 5 a radial cam (not depicted) with one parallel and one oblique surface section, which engages on a projection (not depicted) of arm 19*g* of clamping lever 19, and controls it in the same way as in the embodiment described.

In a development of the apparatus according to FIG. 1, a leaf spring 27 which performs the functions of springs 15 and 26 is provided.

The invention has been described in detail with particular reference to certain preferred embodiments thereof, but it will be understood that variations and modifications can be effected within the spirit and scope of the invention.

I claim:

1. Stapling apparatus (1) for stapling sheets (12) arranged in stacks, with a stapling head (9) which drives staples in from one side of a sheet stack, and with a counterbearing member (13), associated with the opposite side of a sheet stack, on which a clinching apparatus (14) which clinches ends of staples is arranged; said stapling apparatus (1) having a slider (4) that is selectively moved by a drive apparatus (8) having a radial cam mechanism (8*d*, 8*e*, 8*f*), and that controls raising and adjustment of the counterbearing member (13), characterized in that said slider (4) supports said counterbearing member (13) and said clinching apparatus (14), and rests in spring-loaded contact against a radial cam (8*d*) of said radial cam mechanism of said drive apparatus (8);

said slider (4) is guided to move displaceably parallel to a stapling direction (A), and has two surfaces (4*d*, 4*e*) extending parallel thereto and arranged at a given distance from one another;

associated with said surfaces (4*d*, 4*e*) of said slider (4) is a stationary, pivotably mounted clamping element (19) that has two clamping jaws (19*c* and 19*d*), arranged in parallel fashion, and each of said clamping jaws has an edge (19*e* and 19*f*), wherein said edge (19*e*) of one of said clamping jaws (19*c*) is associated with one of said surfaces (4*d*), and said edge (19*f*) of the other of said clamping jaws (19*d*) is associated with the other of said surfaces (4*e*) of said slider (4);

a distance between said clamping jaws (19*c*, 19*d*) of said clamping element (19) is slightly greater than said given distance between said two opposing surfaces (4*d*, 4*e*);

a pivot mount (19*a*) for said clamping element (19) is arranged at a distance (r) from said slider (4) that is in a relationship l/r<two times the coeficient of friction to the length (l) of said clamping jaws (19*c*, 19*d*) which effects self-locking;

said clamping element (19) being selectively positioned in spring-loaded fashion against said surfaces (4*d*, 4*e*) of said slider (4), in a direction of movement (B) of said slider (4) which effects compensation for thickness of a sheet stack; and said stapling head (9) is arranged in stationary fashion beneath the sheet stack (12) being stapled, and is driven positively by a radial cam (8*f*) of said radial cam mechanism of said drive apparatus (8).

2. Stapling apparatus according to claim 1, characterized in that said clamping element (19) has an arm (19*g*) that is selectively positioned in spring-loaded fashion against a projection (5*c*) of an actuator (5) for said clinching apparatus (14) that is mounted so as to move parallel to said slider (4) and is selectively controlled by a radial cam (8*e*) of said radial cam mechanism of said drive apparatus (8).

3. Stapling apparatus according to claim 2, characterized in that said arm (19*g*) of said clamping element (19) has a surface (19*i*) that is arranged parallel to the movement direction (B) of said actuator (5) and is selectively positioned against the projection (5*c*), and a ramp (19*h*) continuous therewith and extending away from said projection (5*c*).

4. Stapling apparatus according to claim 2, characterized in that a projection is arranged on said arm (19*g*) said projection extending into the movement path of a cam-shaped projection, arranged on said actuator (5), which has a surface arranged parallel to the movement direction (B) of said actuator (5) and a ramp continuous therewith.

5. Stapling apparatus according to claim 4, characterized in that said slider (4) has a first arm (4*c*) which projects beyond the region of sheet stack (12) being stapled and on which both said counterbearing member (13) and said clinching apparatus(14) are arranged; and that said slider (4) is equipped with a second arm (4*f*) that engages in spring loaded fashion against said radial cam (8*d*) of said radial cam mechanism of said drive apparatus (8).

6. Stapling apparatus according to claim 5, characterized in that said actuator (5) for said clinching apparatus (14) has arms (5*d*, 5*e*), arranged in a fork shape, which engage against said control cam (8*e*) of said radial cam mechanism of said drive apparatus (8), configured to have the same thickness.

7. Stapling apparatus according to claim 6, characterized in that said drive apparatus is configured as a positively driven radial cam mechanism.

* * * * *